US005579593A

United States Patent [19]

Murray

[11] Patent Number: 5,579,593

[45] Date of Patent: Dec. 3, 1996

[54] RAILROAD BALLAST SPREADING (PLOW) SYSTEM

[75] Inventor: John R. Murray, Findlay, Ohio

[73] Assignee: Difco, Inc., Findlay, Ohio

[21] Appl. No.: 428,669

[22] Filed: Apr. 25, 1995

[51] Int. Cl.[6] ..... B61D 7/30

[52] U.S. Cl. ..... 37/104; 37/405; 104/2; 105/311.1

[58] Field of Search ..... 37/104, 105, 217, 37/405; 104/7.1, 7.2, 7.3, 6, 12, 2, 8, 279; 171/16; 172/782; 105/311.1, 240, 241.2

[56] References Cited

U.S. PATENT DOCUMENTS

| | | | |
|---|---|---|---|
| 2,272,429 | 2/1942 | Philbrick | 37/104 X |
| 3,019,536 | 2/1962 | Kershaw | 37/104 |
| 3,305,952 | 2/1967 | Dressler | 37/104 |
| 3,427,990 | 2/1969 | Bryan, Jr. . | |
| 3,468,042 | 9/1969 | Coy . | |
| 3,677,191 | 7/1972 | Nagy . | |
| 3,722,423 | 3/1973 | Plasser et al. . | |
| 3,731,410 | 5/1973 | Cripe . | |
| 4,249,325 | 2/1981 | Theurer | 37/104 |
| 4,282,663 | 8/1981 | Theurer . | |
| 4,601,244 | 7/1986 | Fischer | 105/240 |
| 4,905,387 | 3/1990 | Street . | |
| 5,094,018 | 3/1992 | Theurer et al. . | |
| 5,423,268 | 6/1995 | Bounds | 37/104 X |

*Primary Examiner*—Terry Lee Melius
*Assistant Examiner*—Robert Pezzuto
*Attorney, Agent, or Firm*—Marshall & Melhorn

[57] ABSTRACT

A railroad ballast spreading system is provided for rail cars used to spread ballast about the rails. A plowshare is mounted beneath the rail car and is supported by a bracket arm connected to the rail car. A curved linkage is also connected to between the rail car and the plowshare. A hydraulic motor or other pressure fluid motor is connected to an intermediate point of the linkage to pivotably move the plowshare from a lowered position for spreading the ballast to a raised, stowed position. The linkage includes a curved crank arm and a curved link arm such that the linkage passes the toggle point between the lowered and stowed position to increase the stability of the plowshare in the stowed position.

7 Claims, 3 Drawing Sheets

RAILROAD BALLAST SPREADING (PLOW) SYSTEM

BACKGROUND OF THE INVENTION

1. Field of the Invention

The present invention relates to a ballast distributing system for utilization with hopper bottom bulk material transporting railway car, and more particularly, to a ballast distributing system including a plow capable of vertical adjustment to ride along the top of the rail to sweep ballast from the rail surface.

2. Description of the Prior Art

Ballast distributing machines have been in use for some years for distributing ballast evenly along a railroad roadbed. The method has been accomplished by the utilization of a plow attached to one end of a railroad vehicle which is capable of spreading the ballast laterally across the roadbed while the associated vehicle is travelling along the track. The ballast is transported and distributed from a railroad car designed specifically for such operations. A separate railroad vehicle is typically used to level the ballast, with the spreading system formed by a railroad tie fixed to the front of the vehicle.

A ballast regulator comprising a ballast plow arrangement mounted on a machine frame between two undercarriages supporting respective ends of the machine frame for mobility on a railroad track is illustrated and described in U.S. Pat. No. 3,877,160. The plow arrangement disclosed therein comprises a vertically adjustable center plow with plowshares pivotal for adjustment about a vertical axis to enable the ballast to be redistributed in any desired manner over the entire width of the ballast bed in a single pass of the machine. Laterally and vertically adjustable shoulder plowshares are associated with the center plow at each side of the machine frame for suitably shaping the ballast shoulders.

A ballast storage silo is arranged on the machine frame between the rear undercarriage and the center plow, the silo having hydraulically operable ballast discharge opening means at an underside thereof so that ballast stored in the silo may be discharged onto the ballast bed in any track section which has too little ballast. While such a ballast plow enables the amount of ballast along the track to be equalized, the small storage capacity of the silo leads to relatively short track sections having either too little or too much ballast after a certain number of such track sections have been plowed.

SUMMARY OF THE INVENTION

It is a primary object of the invention to produce a ballast distributing system which may be readily employed with existing hopper bottom bulk material transporting railway cars.

Another object of the invention is to produce a ballast distributing system for utilization with a railway hopper car wherein the system includes a plow capable of vertical adjustment to ride along the top of the rail in order to sweep the ballast from the rail surface.

Another object of the invention is to produce a ballast distributing system including a horizontally disposed plow and associated mechanism for cleaning over-ballasted track such that the ballast fills the width of the rail bed over the railroad ties to the height of the top of the rail.

Still another object of the invention is to produce a system for attachment to existing railway hopper car for controlled distribution of ballast discharged from the hopper car over the associated railroad roadbeds.

The above as well as other objects of the invention may be typically achieved by a ballast distributing system for attachment to a railway hopper car having an underframe and at least one hopper door for discharging bulk material transported by the hopper car including a plow; a linkage connecting the plow to the underframe of the hopper car; and a hydraulic drive or other suitable drive system coupled to the linkage for moving the plow to a predetermined vertical position.

BRIEF DESCRIPTION OF THE DRAWINGS

The structure and operation of the invention for carrying out the above, as well as other, objectives, will become readily apparent to one who is skilled in the art from reading the following detailed description of a preferred embodiment of the invention when considered in the light of the attached drawings, in which.

DETAILED DESCRIPTION OF THE PREFERRED EMBODIMENT OF THE INVENTION

Figure 1:
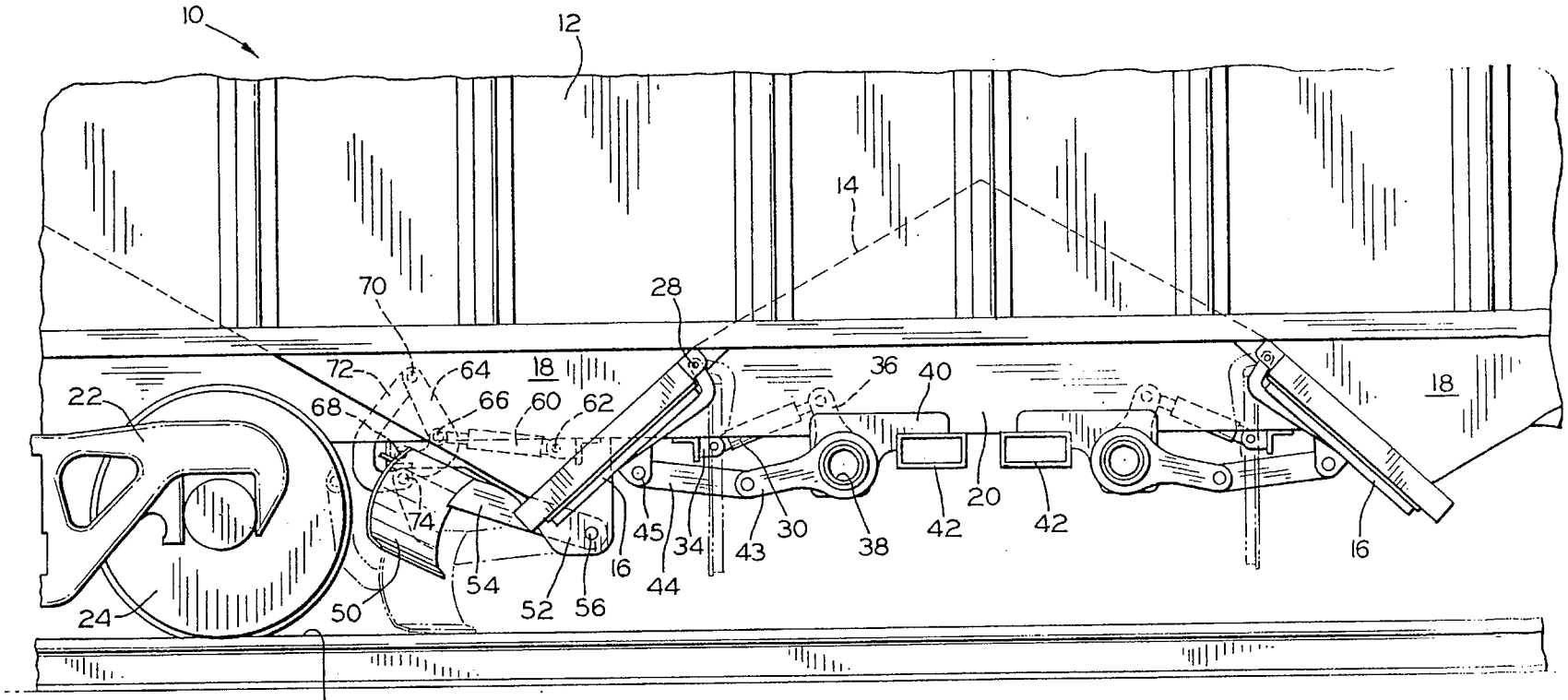
FIG. 1 is a fragmentary side elevational of a railroad hopper car equipped with a railroad ballast spreading system incorporating the novel features of the present invention showing the hopper doors in a closed position and the associated plow in an elevated inoperative position.

Referring to the drawings, there is illustrated a preferred embodiment of the invention attached to a conventional railway hopper car, generally designated by reference numeral 10. The hopper car 10 is provided with side 12 and bottom sections 14 having hopper doors 16 which cooperate to define spaced apart hoppers 18. The hopper doors 16 pivot on an axis which is generally transverse to the longitudinal axis of the hopper car 10. The hoppers 18 are typically supported by the center sill member 20 which is attached to spaced apart trucks 22. The trucks 22 contain the car wheels 24 which ride on the rails 26.

The hopper doors 16 are opened and closed about respective pivot mountings 28 by pressure fluid operated cylinders 30 and associated pivotally interconnected door operating linkage 32 which includes bell crank arms and linkage as illustrated. The hopper door operating mechanism may be of any suitable type capable of the opening and closing of selective hopper doors 16. The hopper door operating mechanism 32 of the preferred embodiment illustrated in the drawings includes a pressure fluid actuated cylinder 30 having one end pivotally mounted to a bracket 34 mounted to the sill member 20, as clearly illustrated in FIG. 3.

The opposite end of the cylinder 30 is pivotally affixed to the distal end of a bell crank 36. The bell crank 36 is securely attached to a tube 38 pivotally mounted in journal blocks carried by brackets 40 mounted to extend from cross members 42 secured to the undersurface of the sill member 20.

A pair of spaced apart bell cranks 43 is securely attached to the ends of the tube 38. The distal ends of the bell cranks 43 are pivotally affixed to one end of a link 44, while the other end of the link 44 is pivotally affixed to a bracket 45 secured to the hopper door 16. A similar linkage arrangement is affixed to the opposite end of the tube 38 and is pivotally attached to the opposite end hopper door 16. A spring plate on the door 16 flexes to allow the linkage 44 to go through the toggle point for door lock in unpowered transit of the car.

A plowshare 50 is pivotally mounted to a bracket assembly 52 by a radius arm 54. It will be appreciated that one end of the arm 54 is welded or otherwise suitably affixed to the plowshare 50, while the other end is pivotally attached to the bracket 52 at pivot connector 56. The bracket assembly 52 depends from the undersurface of the sill 20.

The plowshare 50 is selectively moved about the pivot 56 from an operative position (illustrated in FIG. 3) to an inoperative position (illustrated in full lines in FIG. 1) by pressure fluid operated motor 60 and associated pivotally interconnected plow operating linkage. One end of the motor 60 is pivotally attached to a bracket 62 suitably secured to the undersurface of the sill 20. The opposite end of the motor 60 is pivotally attached to a crank arm 64 at a pivot point 66. The pivot point 66 is disposed intermediate the ends of the arm 64. One end of the arm 64 is pivotally attached at pivot point 68 to the bracket 52, while the other end is pivotally attached at pivot pin 70 to one end of a link arm 72. The opposite end of the arm 72 is pivotally attached at pivot point 74 to the plowshare 50.

Figure 2:
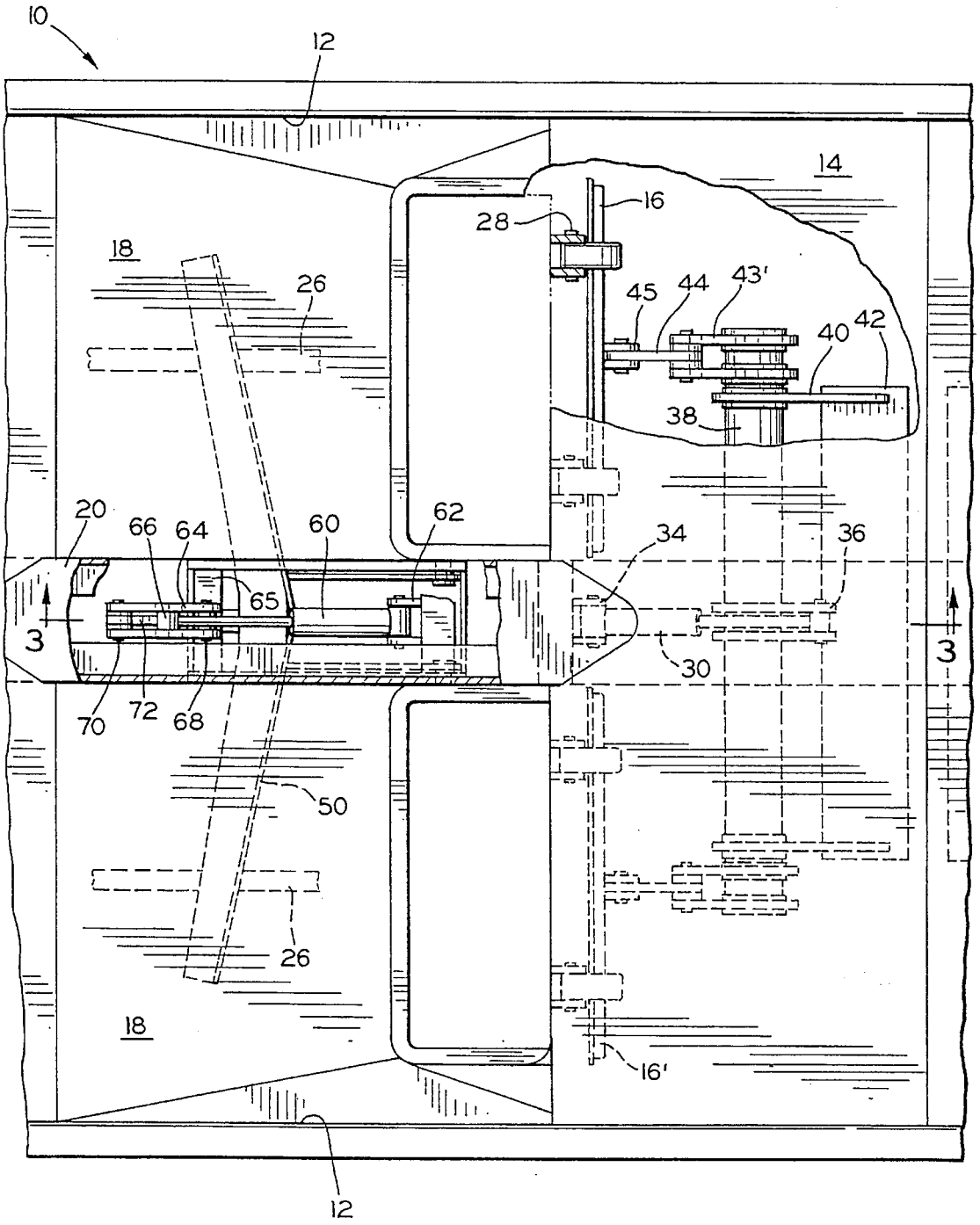
FIG. 2 is a top plan view of the apparatus illustrated in FIG. 1 with portions partially cut-away to more clearly illustrate the structure.
Figure 3:
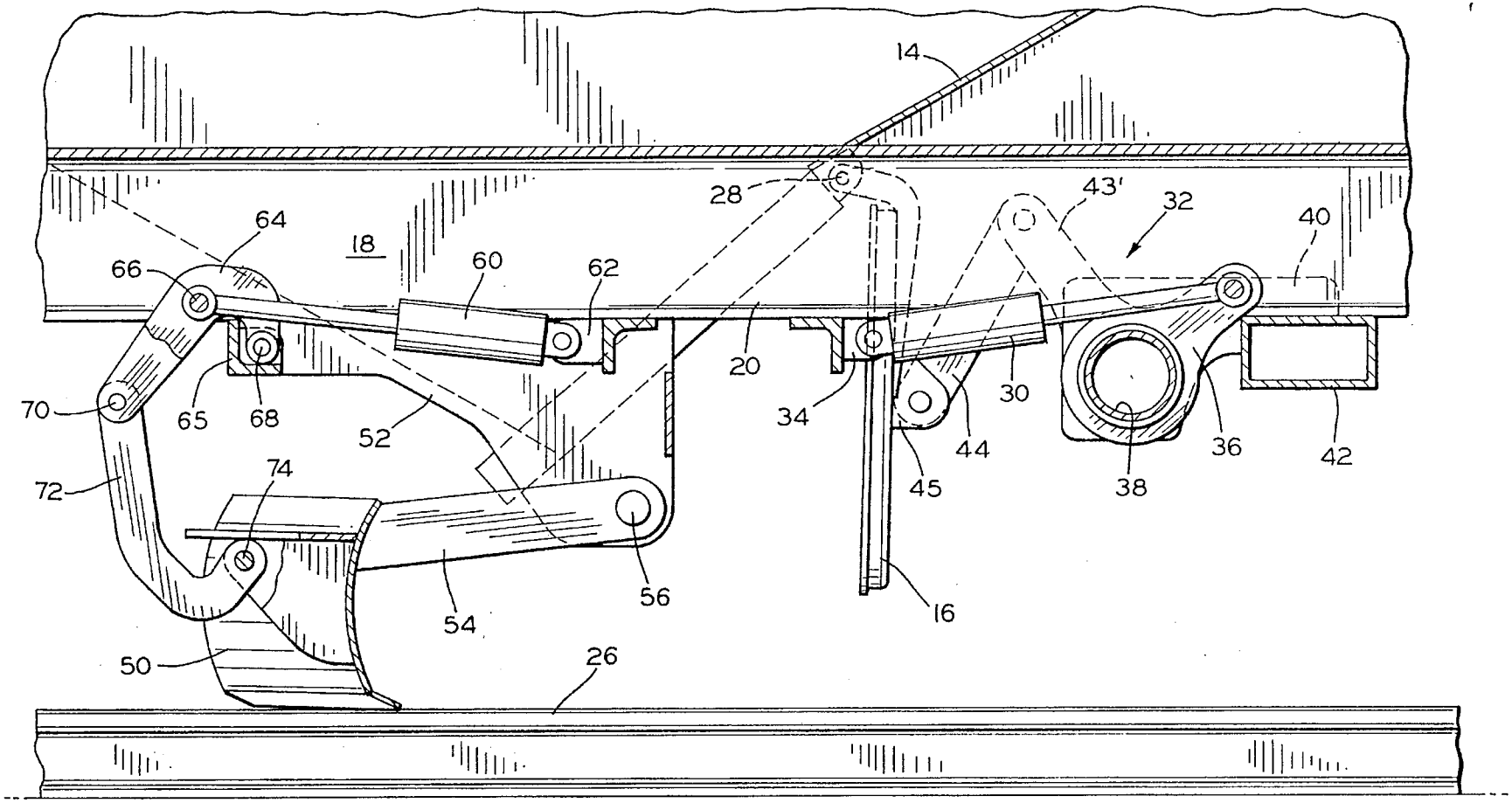
FIG. 3 is an enlarged fragmentary view of the apparatus taken along lines 3-3 of FIG. 2 showing the hopper door in an open position and the associated plow in a lowered operative position.

It can be readily appreciated by viewing FIGS. 2 and 3, in particular, that the positioning of the plowshare 52 is effected by the introduction of pressure fluid to the motor 60 which causes movement of an internal piston (not shown) and associated linkage. In the fully extended position of the motor 60, the crank arm 64 and the arm 72 effectively maintain the plowshare 50 in the lowered operative position. In such position, the plowshare 50 can level the ballast, for example, over the road bed for the width of the plow. The plow sweeps the excess ballast tot he sided of the roadbed without lifting from the track surface as held down by the motor 60. When the plow is retracted by fully reversing the motor, the linkage is designed such that the stowed position is also past the toggle point, which provides the desired stability. It will be appreciated that the operation is initiated by energizing the motor 60 to open the hopper doors 16. The ballast within the hopper car 10 is then discharged onto the road bed and equally distributed by the plowshare 50.

At the conclusion of the ballast distribution operation, the hopper doors 16 are closed and the plowshare 50 is lifted to the position illustrated in full lines in FIG. 1.

In operation, the motor 60 drives the plowshare 50 to the upper surface of rail 26 and hold the plowshare 50 in such position for the over-ballasting operation associated with ballast cleaning maintenance. If the motor 60 and arms 64, 72 do not properly position the plowshare 50, the mounded ballast would lift plow and possibly derail the railway car.

In railway cars 10 with automated doors 16 that open and close without door reconfiguration to prevent ballasting on top of the rails 26, the plowshare 50 must rest on or just above the top surface of rail 26 to keep the rail top swept clean. The plowshare 50 may also include a trailing roller (not shown) to support the plow share on the tracks 26. When the motor 60 is at rest, large ballast load could lift the plowshare 50 off the rail and prevent clearing ballast from the rolling surface of the rails.

In accordance with the provisions of the patent statutes, the present invention has been described in what is considered to represent its preferred embodiment. However, it should be understood that the invention can be practiced otherwise than as specifically illustrated and described without departing from its spirit or scope.

What is claimed is:

1. A retractable plowshare apparatus for mounting underneath a rail car to selectively distribute ballast being discharged from the rail car moving on a pair of railroad rails, said plowshare apparatus comprising:

a plowshare disposed beneath a rail car, said plowshare having a front surface for contacting the ballast and a rear surface;

a bracket arm having a first end pivotably connected to the rail car and a second end attached to said plowshare, said bracket arm permitting movement of said plowshare about a horizontal axis extending through the first end of said bracket arm transverse to a line of travel of the rail car;

a curved linkage having a first end pivotably connected to the rail car and a second end pivotably connected to said plowshare; and a pressure fluid actuated extensible motor having a first end connected to the rail car and a second end connected to an intermediate point on said curved linkage, whereby the extension of said motor lowers said plowshare from the rail car to contact the ballast, and the contraction of said motor raises said plowshare into a stowed position.

2. The retractable plowshare apparatus defined in claim 1, wherein said curved linkage includes an intermediate pivotable connection.

3. The retractable plowshare apparatus defined in claim 1, wherein said curved linkage includes a crank arm connected to the rail car, a link arm connected to said plowshare, and an intermediate pivotable connector for connecting the crank arm to the link arm.

4. The retractable plowshare apparatus defined in claim 3, wherein said extensible motor is connected to an intermediate point on the crank arm.

5. The retractable plowshare apparatus defined in claim 4, wherein the intermediate point of connection for said extensible motor is spaced apart from a pivotable connection at the first end of said curved linkage such that intermediate point is positioned on a rear side of the first end pivotable connection when the plowshare is in the lowered position and is positioned on a front side of the first end pivotable connection when the plowshare is in the stowed position.

6. The retractable plowshare apparatus defined in claim 1, wherein said extensible motor is positioned above an upper edge of said plowshare between said plowshare and the rail car.

7. The retractable plowshare apparatus defined in claim 6, wherein said extensible motor is maintained in a generally horizontal position when said plowshare is lowered for ballast distribution and when said plowshare is raised to the stowed position.

* * * * *